US006965680B2

(12) United States Patent
Yamauchi et al.

(10) Patent No.: US 6,965,680 B2
(45) **Date of Patent: *Nov. 15, 2005**

(54) PIEZOELECTRIC ELECTRO-ACOUSTIC TRANSDUCER

(75) Inventors: Masakazu Yamauchi, Toyama-ken (JP); Tetsuo Takeshima, Toyama (JP); Manabu Sumita, Toyama (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 224 days.

This patent is subject to a terminal disclaimer.

(21) Appl. No.: 10/409,573

(22) Filed: Apr. 8, 2003

(65) Prior Publication Data

US 2003/0202672 A1 Oct. 30, 2003

(30) Foreign Application Priority Data

Apr. 26, 2002 (JP) ..... 2002-126769
Jan. 16, 2003 (JP) ..... 2003-008746

(51) Int. Cl.[7] ..... H04R 25/00
(52) U.S. Cl. ..... 381/190; 381/173; 310/348
(58) Field of Search ..... 381/114, 173, 190, 381/191, 174; 310/322, 323.06, 324, 330, 310/340, 344, 348, 800, 334; 29/25.35; 367/155, 367/157, 180

(56) References Cited

U.S. PATENT DOCUMENTS 6,472,798 B2 * 10/2002 Kishimoto ..... 310/344
6,570,299 B2 * 5/2003 Takeshima et al. ..... 310/348
6,653,762 B2 * 11/2003 Takeshima ..... 310/340

FOREIGN PATENT DOCUMENTS

JP 61-161100 A 7/1986
JP 3-175800 A 7/1991

* cited by examiner

*Primary Examiner*—Huyen Le
(74) *Attorney, Agent, or Firm*—Keating & Bennett, LLP

(57) ABSTRACT

A piezoelectric electro-acoustic transducer includes a piezoelectric vibration plate having a plurality of piezoelectric ceramic layers laminated to each other with an internal electrode being interposed between the ceramic layers, and main surface electrodes provided on the front and back surfaces thereof, whereby area bending vibration is produced by applying an AC signal between the main surface electrodes and the internal electrode, respectively, a resin film having a size that is greater than the piezoelectric vibration plate and having the piezoelectric vibration plate bonded substantially to the central portion of the surface thereof, and a casing which accommodates the piezoelectric vibration plate and the resin film. The piezoelectric vibration plate has an area of about 40% to about 70% of that of the resin film. The inner peripheral surface of the case is provided with a supporting portion having a frame shape that is larger than that of the piezoelectric vibration plate, and the outer peripheral portion of the resin film having no piezoelectric vibration plate bonded thereto is supported by the supporting portion of the case.

18 Claims, 22 Drawing Sheets

PIEZOELECTRIC ELECTRO-ACOUSTIC TRANSDUCER

BACKGROUND OF THE INVENTION

1. Field of the Invention

The present invention relates to a piezoelectric electro-acoustic transducer such as a piezoelectric receiver, a piezoelectric sounder, or a piezoelectric speaker.

2. Background of the Invention

In electronic devices and apparatuses, such as household electronic appliances and portable telephones, electro-acoustic transducers have been widely used as piezoelectric sounders to generate acoustic alarms or operational sounds and piezoelectric receivers.

Generally, such an electro-acoustic transducer includes a piezoelectric plate that is bonded to one side or both sides of a metallic sheet to define a vibration plate, the periphery of the metallic sheet is bonded and fixed to a case, and the opening of the case is closed with a cover.

For such vibration plates as described above, a piezoelectric plate which radially vibrates is constrained by the metallic plate which suffers no area-changes, such that an area bending vibration is generated. Accordingly, the acoustic conversion efficiency is low. It is difficult to provide a vibration plate having a reduced size and also provide a sound pressure characteristic including a low resonance frequency.

The Applicants of the present invention have proposed in Japanese Unexamined Patent Application Publication No. 2002-10393 a piezoelectric vibration plate having a high acoustic conversion efficiency. In the piezoelectric vibration plate, two or three piezoelectric ceramic layers are laminated. Main surface electrodes are provided on the front and back main surfaces of the laminate. An internal electrode is provided between the ceramic layers. A side surface electrode to connect the main surface electrodes to each other is provided on a side surface of the laminate. A side surface electrode to be connected to the internal electrode is provided on another side surface of the laminate. The ceramic layers are polarized in the same thickness direction. The laminate vibrates in an area bending mode by application of an AC signal between the main surface electrodes and the internal electrode to generate a sound.

The piezoelectric vibration plate having the above-described structure is a ceramic lamination structure. The two vibration regions (ceramic layers) sequentially arranged in the thickness direction vibrate in the opposite directions to each other. Accordingly, the displacement is increased as compared to the vibration plate in which the piezoelectric plates are bonded to the metallic sheet. That is, an increased sound pressure is obtained.

The above-described piezoelectric vibration plate, although it has a high acoustic conversion efficiency, has problems in that when the vibration plate is supported in a case, the periphery of the vibration plate must be closely sealed, which increases the resonance frequency. For example, in a case in which two opposite sides of a piezoelectric vibration plate with a size of 10 mm×10 mm are bonded to a case, and the other two sides are elastically sealed in such a manner as to be freely displaceable, the resonance frequency is about 1200 Hz, and the sound pressure is considerably reduced in the vicinity of 300 Hz which is the lower limit of the frequency band of human speech.

In the case of piezoelectric receivers, an electro-acoustic transducer which is capable of producing a wide band speed having a substantially flat sound pressure characteristic in the frequency range of 300 Hz to 3.4 KHz, that is, the frequency band of human speech, has been demanded. However, according to the above-described supporting structure, a substantially flat sound pressure characteristic in a wide band cannot be achieved. The resonance frequency can be reduced by increasing the sizes of the case and the vibration plate. However, the size of the electro-acoustic transducer is increased accordingly.

Japanese Unexamined Patent Application Publication No. 4-132497 discloses a flat speaker in which an electric feeding circuit is formed of conductive paste on the inner surface of a sheet member which has the periphery reinforced and supported by a rigid frame. A piezoelectric ceramic plate or a piezoelectric vibration plate including a metallic sheet having a piezoelectric plate bonded thereto is bonded to the feeding circuit. In this case, a substantially flat frequency characteristic in a wide band is attained.

When a unimorph piezoelectric vibration plate, that is, a metallic plate having a piezoelectric ceramic sheet bonded thereto is used, the vibration plate itself vibrates in a bending vibration mode, and thus, the plate operates as a speaker. On the other hand, when a piezoelectric ceramic plate is bonded directly to the sheet member, the piezoelectric ceramic plate is expanded and contracted in the plane direction. Thus, a desired speaker characteristic cannot be attained in some cases. Moreover, if the sheet member is excessively large as compared to the vibration plate, an effective sound pressure characteristic cannot be attained, and the size of an electro-acoustic transducer is increased.

SUMMARY OF THE INVENTION

To overcome the problems described above, preferred embodiments of the present invention provide a piezoelectric electro-acoustic transducer having a reduced size and resonance frequency, an increased displacement, and which is capable of reproducing a wide band speech.

According to a first preferred embodiment of the present invention, a piezoelectric electro-acoustic transducer includes a piezoelectric vibration plate having a plurality of piezoelectric ceramic layers laminated to each other with an internal electrode interposed between the ceramic layers, and main surface electrodes provided on the front and back main surfaces thereof, whereby area bending vibration is caused by the application of an AC signal between the main surface electrodes and the internal electrode, respectively, a resin film having a size that is greater than the piezoelectric vibration plate and having the piezoelectric vibration plate bonded substantially to the central portion of the surface thereof, and a case which accommodates the piezoelectric vibration plate and the resin film, the piezoelectric vibration plate having an area of about 40% to about 70% of that of the resin film, the inner peripheral surface of the case being provided with a supporting portion having a frame size that is greater than that of the piezoelectric vibration plate, and the outer peripheral portion of the resin film having no piezoelectric vibration plates bonded thereto being supported by the supporting portion of the case.

According to a second preferred embodiment of the present invention, a piezoelectric electro-acoustic transducer includes a first piezoelectric vibration plate having a piezoelectric ceramic layer and main surface electrodes provided on the front and back main surfaces of the piezoelectric ceramic layer, whereby area expansion vibration is generated by the application of an AC signal between the main surface electrodes on the front and back main surfaces; a second piezoelectric vibration plate having main surface electrodes provided on the front and back main surfaces thereof, whereby an area expansion vibration is generated in the opposite direction to that of the first piezoelectric vibration plate by the application of the AC signal between the main surface electrodes on the front and back main surfaces thereof, a resin film having a size that is greater than each of the first and second piezoelectric vibration plates and having the first and second piezoelectric vibration plates bonded substantially to the central portions of the front and back main surfaces thereof, and a case which accommodates the piezoelectric vibration plates and the resin film, the first and second piezoelectric vibration plates each having an area of about 40% to about 70% of that of the resin film, the inner peripheral surface of the case being provided with a supporting portion having a frame size that is greater than that of each piezoelectric vibration plate, and the outer peripheral portion of the resin film having no piezoelectric vibration plates bonded thereto being supported by the supporting portion of the case.

According to the first preferred embodiment of the present invention, the resin film having a size that is greater than the piezoelectric vibration plate is bonded to one side of the piezoelectric vibration plate which generates area bending vibration. The outer peripheral portion of the film is supported by the supporting portion of the case. Accordingly, the piezoelectric vibration plate is attached to the case without substantially constraining the piezoelectric vibration plate. The piezoelectric vibration plate vibrates more easily that the related art piezoelectric vibration plate in which two or four sides are supported by the case. Thus, even if the vibration plate has the same size as that of the related art vibration plate, the resonance frequency is reduced. Further, the displacement is increased due to the reduction of the constraining force, such that an increased sound pressure is produced.

Sound pressure is provided without the fundamental resonance being converted to a tertiary resonance. Thus, the transducer reproduces a wide band speed.

The following results have been experimentally confirmed: the area (area ratio) of the vibration plate relative to a sheet member has a relationship to the sound pressure characteristic, when the area ratio of the piezoelectric vibration plate is changed, the sound pressure characteristic is satisfactory in the area-ratio range of the vibration plate of about 40% to about 70%, and if the area ratio is less than about 40% or greater than about 70%, the sound pressure is reduced. Therefore, according to preferred embodiments of the present invention, the area ratio of the piezoelectric vibration plate based on the resin film is preferably within the range of about 40% to about 70%.

The resin film also functions as a sealing material which seals the gap between the case and the vibration plate. In sealing between the vibration plate and the case according to the related art, the Young's modulus of elasticity and the coating amount of a sealing agent substantially influences the vibration characteristic. On the other hand, according to preferred embodiments of the present invention, the vibration plate is not directly bonded to the case. Thus, the Young's modulus of elasticity and the coating amount of a sealing agent does not have significant influence the resonance characteristic. Accordingly, selection of a sealing agent and control of the coating amount is easily performed.

The resin film may be bonded to the entire surface of the vibration plate. Alternatively, the resin film may be bonded to only the peripheral portion of the vibration plate. In this case, the resin film has a frame shape so as to be provided only at the peripheral portion of the vibration plate.

Preferably, the piezoelectric vibration plate includes electrode lead-out portions for externally leading out the main surface electrodes and the internal electrode of the piezoelectric vibration plate provided at the approximate center of opposed sides of the piezoelectric vibration plate, the case includes first and second terminals fixed thereto, the terminals having one end exposed near the corner on the inner side of the case, and the electrode lead-out portions of the piezoelectric vibration plate are electrically connected to the one end of the first and second terminals by coating a conductive adhesive from the electrode lead-out portions to the one end of the first and second terminals in the vicinities to the corners of the resin film, respectively, while the resin film having the piezoelectric vibration plate bonded thereto is supported by the supporting portion of the case.

For area bending vibration of the vibration plate, an AC signal is applied between the main surface electrodes and the internal electrode of the vibration plate. The electrode lead-out portions of the piezoelectric vibration plate are connected to the terminals via the resin film via a conductive adhesive. However, in some cases, the coating position and the shape of the conductive adhesive disrupt the displacement of the vibration plate. The experiments performed by the inventors has provided the following results: the electrode lead-out portions are provided at the approximate centers of opposed sides of the piezoelectric vibration plate, and a conductive adhesive is coated continuously from the electrode lead-out portions to the terminals in the vicinities to the corners of the resin film, whereby the resonance frequency is reduced, and the desired sound pressure characteristic not including splitting of the sound pressure is achieved while the displacement of the vibration plate is not disrupted.

To apply the conductive adhesive, known methods such as dispensing, printing, and other suitable methods may be used.

Preferably, thin film electrodes are arranged so as to continuously extend from the electrode lead-out portions for externally leading out the main surface electrodes and the internal electrode of the piezoelectric vibration plate to the periphery of the resin film, the case includes the first and second terminals fixed thereto, the terminals having one ends exposed on the inner side of the case, and the one end of the first and second terminals are connected to the thin film electrodes provided at the periphery of the resin film via a conductive material.

According to preferred embodiments of the present invention, the area ratio of the piezoelectric vibration plate based on the resin film is in the range of about 40% to about 70%. Thus, the resin film having a predetermined width is provided in the periphery of and on the outside of the piezoelectric vibration plate. Accordingly, when the electrode lead-out portions of the piezoelectric vibration plate are connected to the terminals of the case via the conductive adhesive, the hardened conductive adhesive sticks to the surface of the resin film over a desired length, which disrupts the displacement of the resin film.

As described above, instead of the conductive adhesive, the thin film electrodes are arranged so as to continuously extend from the electrode lead-out portions for externally leading out the main surface electrodes and the internal electrode of the piezoelectric vibration plate to the periphery of the resin film. In this case, the thin film electrodes are simply provided on the resin film. This causes substantially no disruption to the displacement of the resin film. An outstanding sound pressure characteristic is thus obtained.

When the thin film electrodes provided on the periphery of the resin film are connected to the terminals, an AC signal can be applied to the piezoelectric vibration plate via the terminals. The periphery of the resin film has a conductive material (conductive paste or other suitable conductive material) adhered thereto. However, the periphery of the resin film vibrates very little. Thus, the conductive material does not substantially influence the vibration characteristic.

Referring to a method of connecting the thin film electrodes to the electrode lead-out portions of the piezoelectric vibration plate, for example, a portion of the thin film electrodes overlap the electrode lead-out portions when the thin film electrodes are formed. Also, the thin film electrodes may be connected to the electrode lead-out portions using a conductive adhesive. In this case, the thin film electrodes are formed on the resin film in advance. The piezoelectric vibration plate is simply bonded to the resin film. Thus, the production efficiency is greatly improved.

The thin film electrodes can be formed by a known method of forming a thin film such as sputtering, vapor deposition, etching, and other suitable methods.

According to the second preferred embodiment of the present invention, the first piezoelectric vibration plate which generates area expansion vibration and the second piezoelectric vibration plate which generates area expansion vibration in the opposite direction to that of the first piezoelectric vibration plate are bonded to the front and back main surfaces of the resin film. That is, the first and second piezoelectric vibration plates define a bimorph vibration plate. Also, the two piezoelectric vibration plates are attached to the case via the resin film. Therefore, the area bending vibration of the piezoelectric vibration plates is not constrained. Thus, similar to the electro-acoustic transducer according to the first preferred embodiment of the present invention, advantages such as low resonance frequency, increased displacement, and reproduction of wide-band speech are obtained.

Preferably, the resin film has a thickness that is less than each piezoelectric vibration plate, and is made of a resin material having a Young's modulus of elasticity of about 500 MPa to about 15,000 MPa.

If the resin film has a thickness that is greater than the piezoelectric vibration plate, the vibration of the piezoelectric vibration plate may be constrained. This causes a reduction of the sound pressure. Thus, the reduction of the sound pressure is prevented by providing the resin film having a thickness that is smaller than the piezoelectric vibration plate. If the Young's modulus of elasticity is excessively low, the resin film can be undesirably stretched and contracted, such that a desired sound pressure cannot be achieved. For the resin film, materials such as epoxy, acryl, polyimide, polyamide types and other suitable resins having a Young's modulus of elasticity of about 500 MPa to about 15,000 MPa measured when the materials are in the hardened state are preferably used.

Preferably, the resin film is thermally resistant at a temperature of about 300° C. or higher. In particular, re-flow soldering is widely used to mount electro-acoustic transducers onto circuit substrates. The temperature for the re-flow soldering is preferably about 260° C. Thus, the resin film having a thermal resistance above the re-flow temperature greatly improves the reliability of the electro-acoustic transducer.

The structure of the case is not limited to one including a concave case and a flat-plate cover. For example, the case may be formed by connecting a concave case to a concave cover that is opposed to the case. Also, a piezoelectric vibration plate having a film may be fixed on the inside of a frame having a supporting portion, and covers are attached to the front and back sides of the frame, whereby a case is provided. Furthermore, a frame-shaped supporting portion may be provided on a flat base sheet, a piezoelectric vibrator having a resin film is attached to the supporting portion, and a cover is placed thereon. In the case where the base sheet is used, terminal electrodes may be disposed in a pattern on the base sheet in advance.

Other features, elements, characteristics and advantages of the present invention will become more apparent from the following detailed description of preferred embodiments thereof with reference to the attached drawings.

DETAILED DESCRIPTION OF PREFERRED EMBODIMENTS

Figure 1:
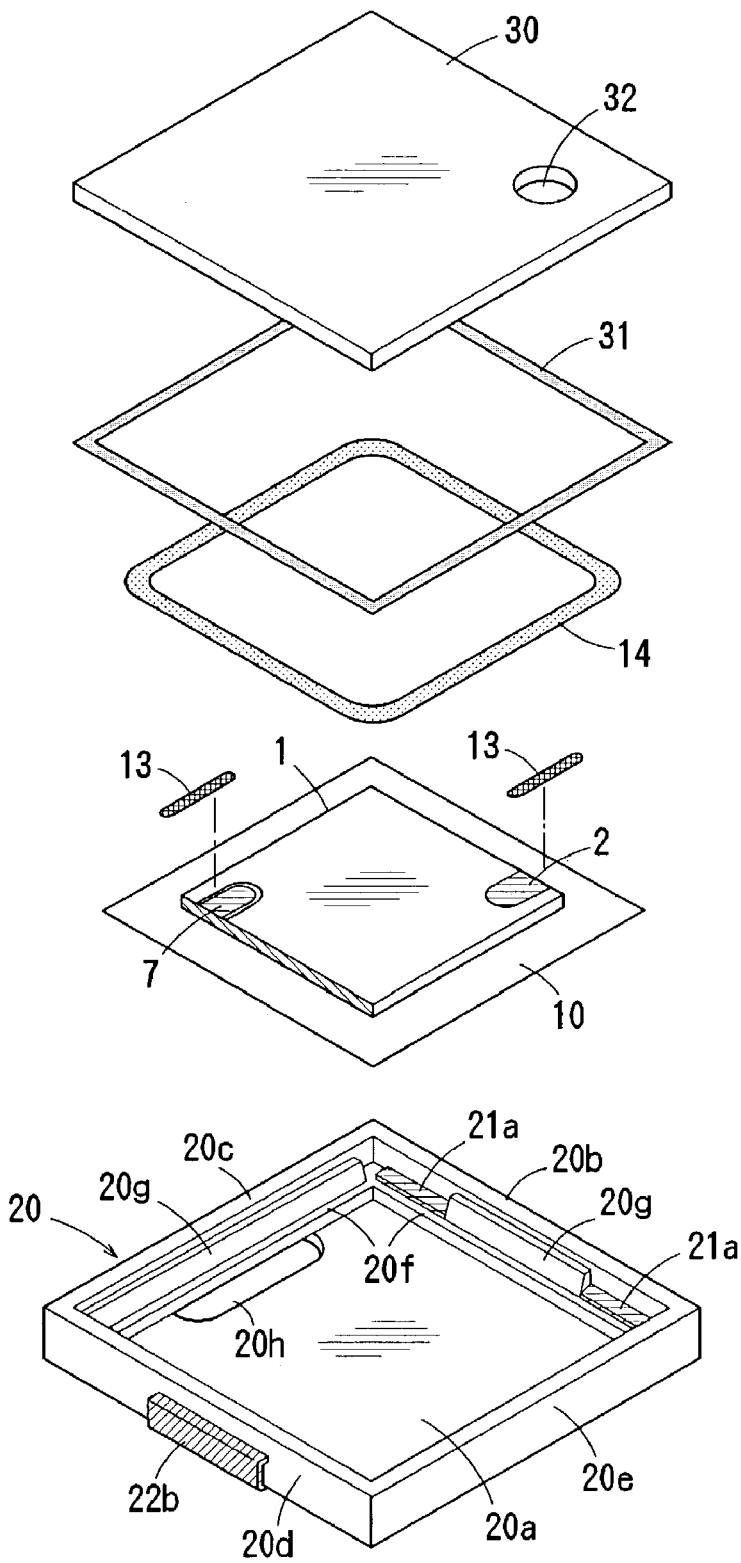
FIG. 1 is an exploded perspective view of a piezoelectric electro-acoustic transducer according to a first preferred embodiment of the present invention.
Figure 2:
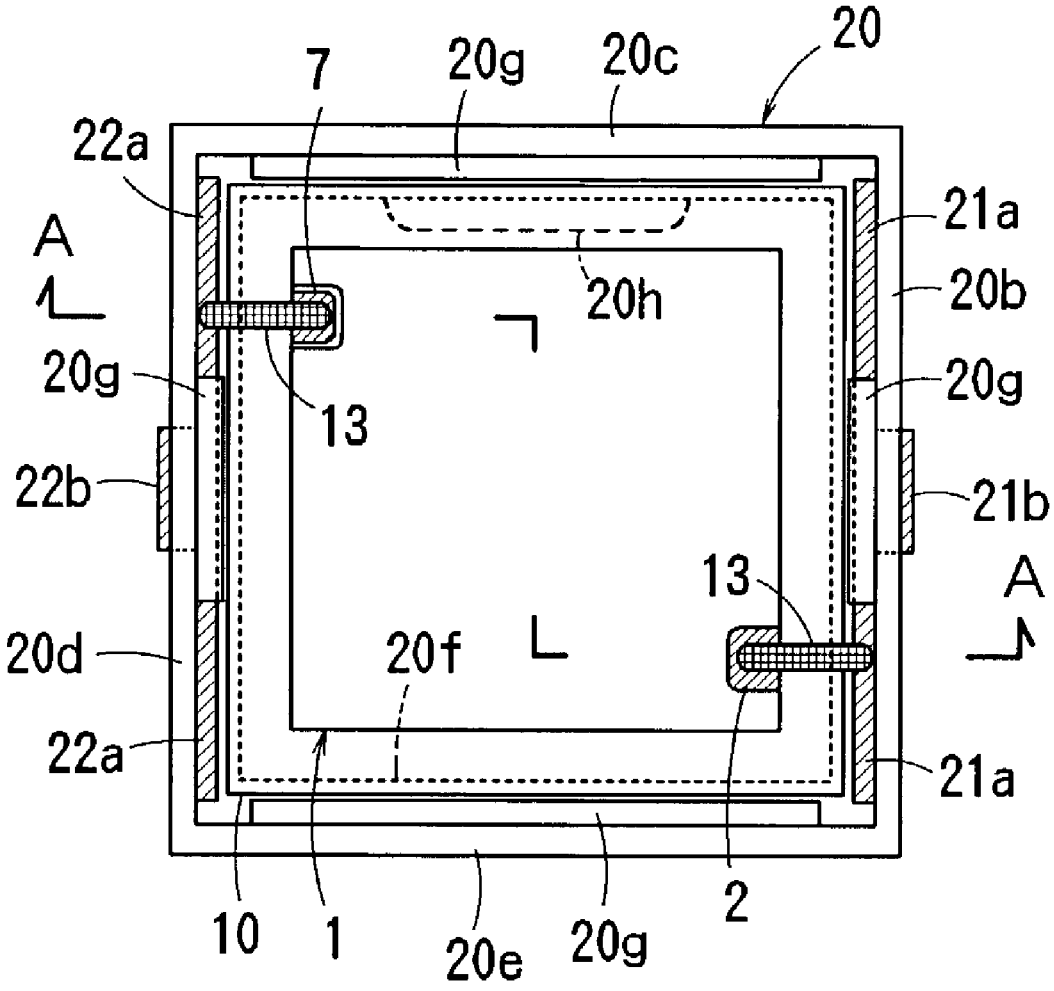
FIG. 2 is a plan view of the piezoelectric electro-acoustic transducer shown in FIG. 1 from which the cover and sealing adhesive are removed.
Figure 3:
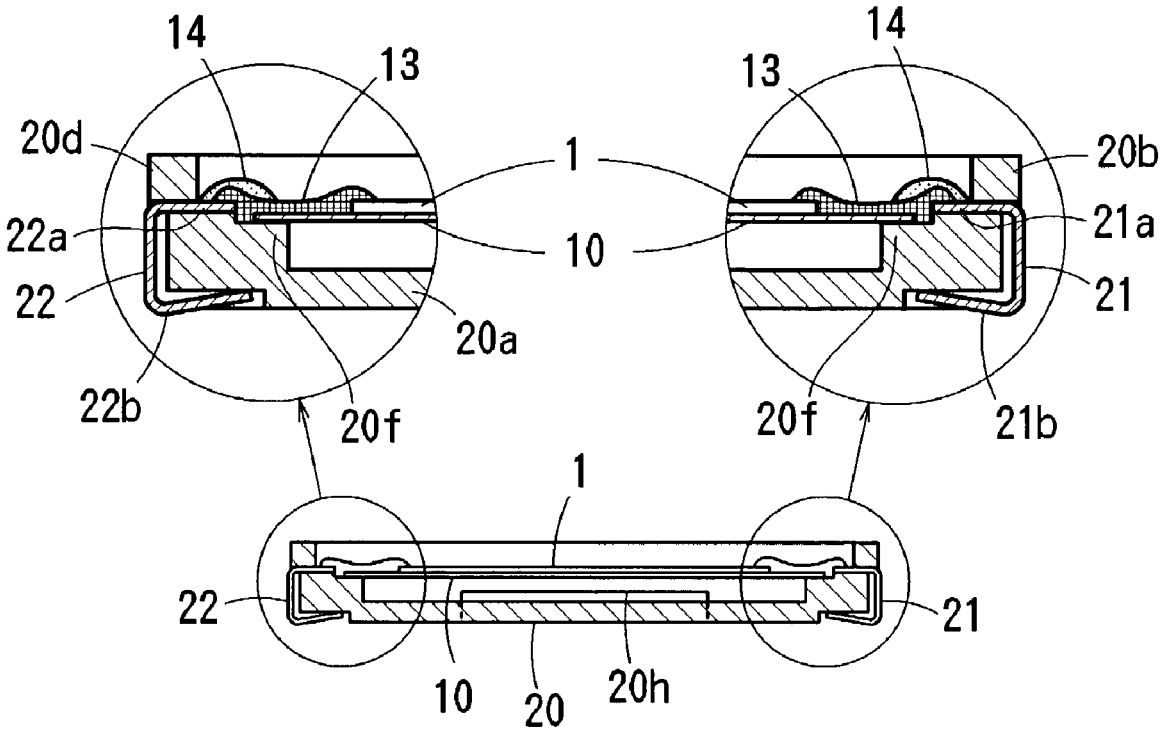
FIG. 3 consists of cross-sectional views step-wise taken along line A—A in FIG. 2.
Figure 4:
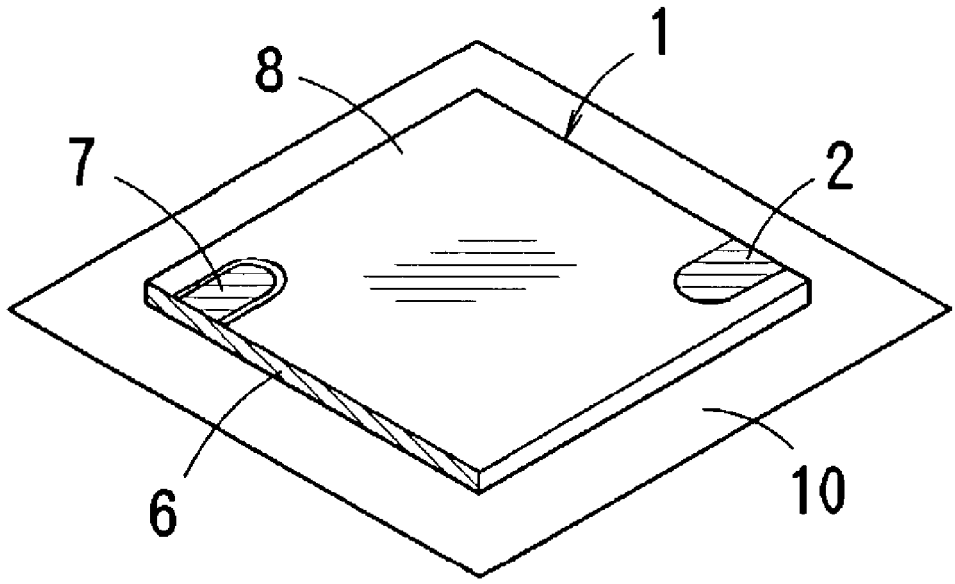
FIG. 4 is a perspective view of a vibration plate having a resin film.

FIGS. 1 to 7 show a surface-mounting type piezoelectric electro-acoustic transducer according to a first preferred embodiment of the present invention.

The electro-acoustic transducer according to this preferred embodiment, such as a piezoelectric receiver, reproduces a wide-band speech having a substantially flat sound pressure characteristic in a human speech band (300 Hz to 3.4 kHz). The transducer includes a piezoelectric vibration plate 1 having a laminated structure, a resin film 10, a case 20, and a cover 30. Here, a casing includes the case 20 and the cover 30.

Figure 5:
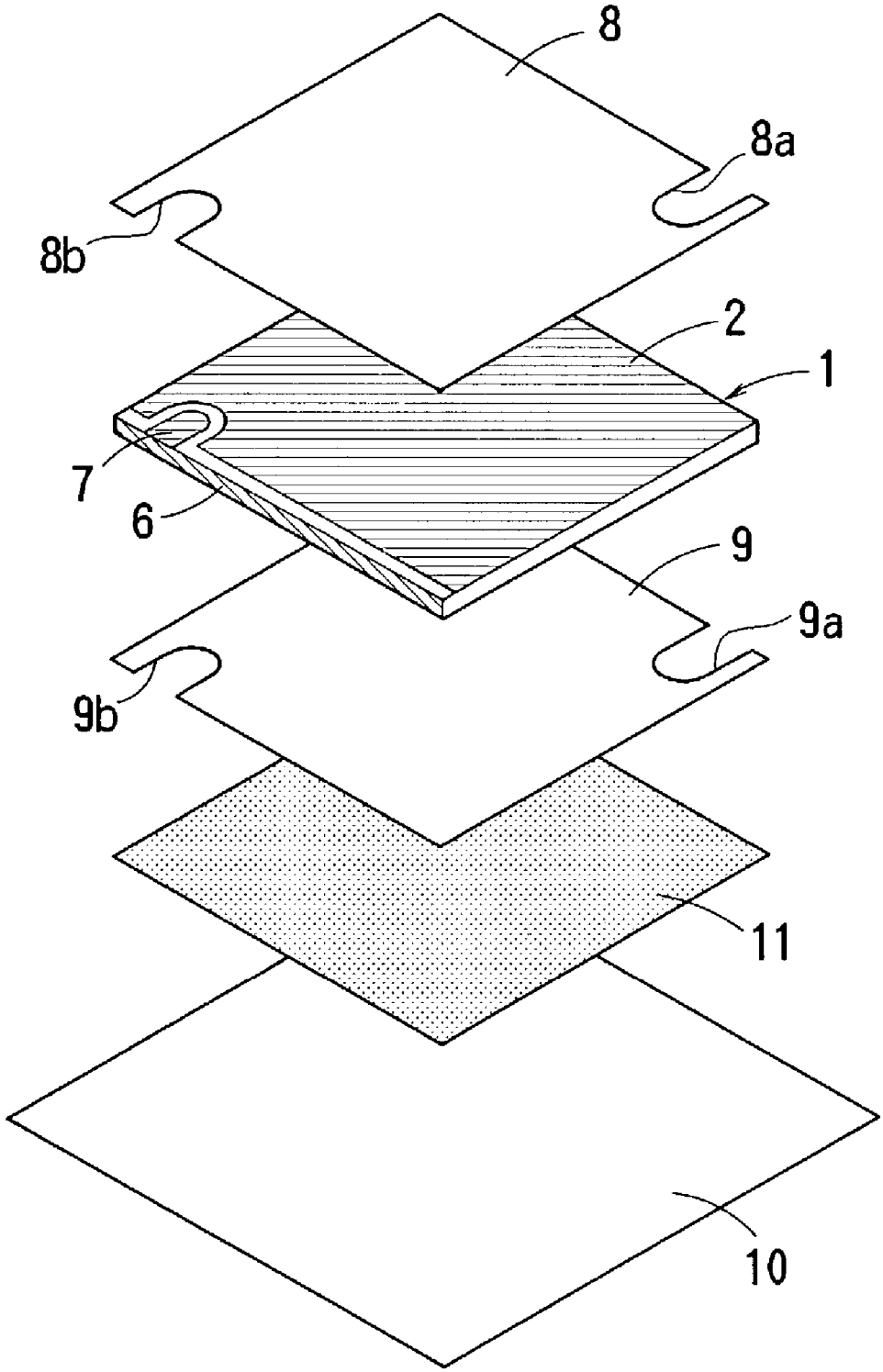
FIG. 5 is an exploded perspective view of the vibration plate having a resin film.
Figure 6:
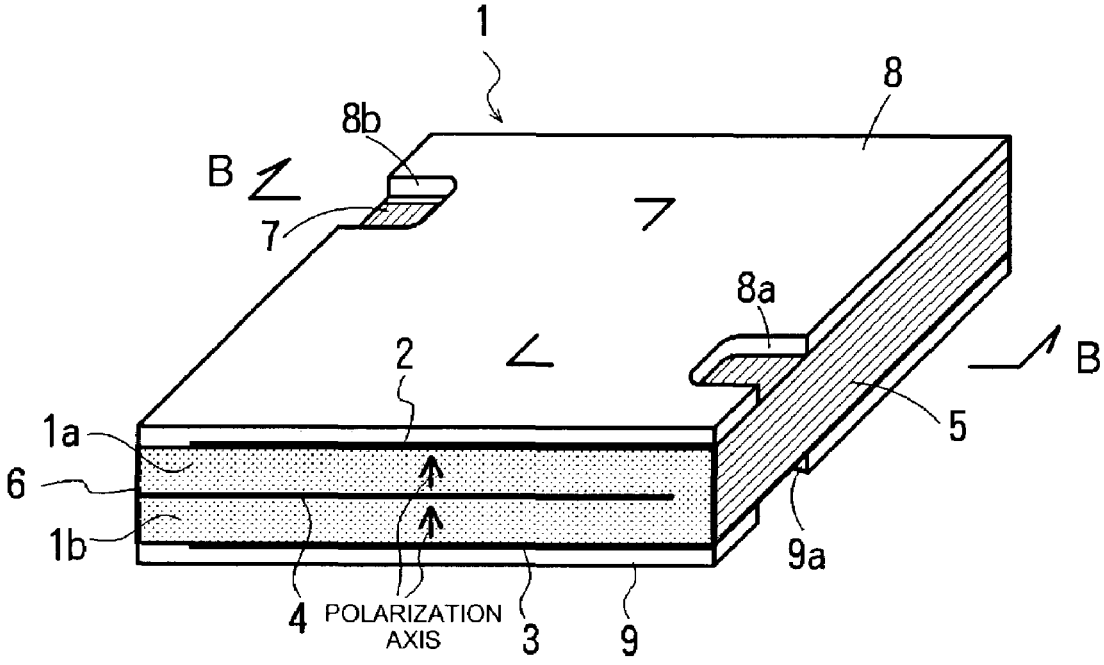
FIG. 6 is an enlarged perspective view of a piezoelectric vibration plate.
Figure 7:
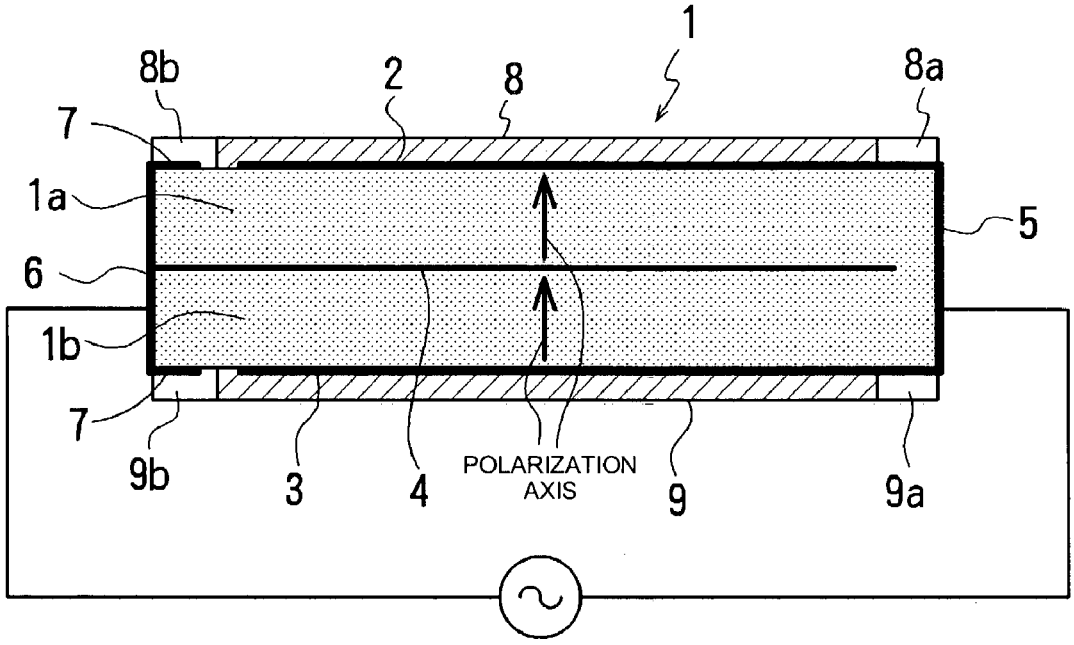
FIG. 7 is a cross sectional view step-wise taken along line B—B in FIG. 6.

The vibration plate 1 is formed preferably by laminating two layers, that is, piezoelectric ceramic layers 1*a* and 1*b*, as shown in FIGS. 5 to 7. Main surface electrodes 2 and 3 are provided on the front and back main surfaces of the piezoelectric vibration plate 1, respectively. An internal electrode 4 is provided between the ceramic layers 1*a* and 1*b*. The two ceramic layers 1*a* and 1*b* are polarized preferably in the same thickness direction as shown by bold line arrows. The main surface electrode 2 on the front surface and the main surface electrode 3 on the back surface are configured such that the length of each side of the main surface electrodes 2 and 3 is slightly less than the length of the corresponding side of the vibration plate 1. One end of each of the main surface electrodes 2 and 3 is connected to an end surface electrode 5 provided on one end surface of the vibration plate 1. Therefore, the main surface electrodes 2 and 3 are connected to each other. The internal electrode 4 is arranged so as to be substantially symmetrical with respect to each of the main surface electrodes 2 and 3. One end of the internal electrode 4 is separated from the end surface electrode 5. The other end of the internal electrode 4 is connected to an end surface electrode 6 provided on the other end surface of the vibration plate 1. Assisting electrodes 7 are provided on the front and back surfaces of the other ends of the vibration plate 1 so as to be connected to the end surface electrode 6. The assisting electrodes 7 of this preferred embodiment are partial electrodes which are provided on only the portions of the vibration plate 1 which correspond to notches 8*b* and 9*b* of resin layers 8 and 9, respectively, which will be described below. The assisting electrodes 7 may be belt-shaped electrodes extending over a desired width along the other end of the vibration plate 1.

The resin layers 8 and 9 are provided on the front and back surfaces of the vibration plate 1 so as to cover the main surface electrodes 2 and 3, respectively. The resin layers 8 and 9 are provided, if necessary. The resin layers 8 and 9 function as protective layers which prevent cracking of the vibration plate 1 which may be caused by external forces applied thereto. The resin layers 8 and 9 on the front and back surfaces are provided with notches 8*a* and 9*a* and the notches 8*b* and 9*b* which are located near the diagonal corners of the vibration plate 1. A portion of the main surface electrodes 2 and 3 are exposed through the notches 8*a* and 9*a*, and the assisting electrodes 7 are exposed through the notches 8*b* and 9*b*, respectively. According to this preferred embodiment, the portion of the main surface electrode 2 and the assisting electrode 7 exposed through the notches 8*a* and 8*b* of the resin layer 8 on the front surface include electrode-lead-out portions, respectively.

The notches 8*a*, 8*b*, 9*a*, and 9*b* may be formed on only one of the front and back surfaces. In this example, the notches 8*a*, 8*b*, 9*a*, and 9*b* are formed on both of the front and back surfaces.

In this example, for the ceramic layers 1*a* and 1*b*, square-shaped PZT type ceramics of which one side is about 6 mm to about 8 mm long and the thickness of one layer is about 15 $\mu$m are used. For the resin layers 8 and 9, polyamide-imide resins having a thickness of about 5 $\mu$m to about 10 $\mu$m are used.

The vibration plate 1 is bonded to the central portion of a surface of the large resin film 10 which is larger than the vibration plate 1 via an epoxy type adhesive 11.

The resin film 10 has a thickness that is less than that of the piezoelectric vibration plate 1 and is formed of a resin material having a Young's modulus of elasticity of about 500 MPa to about 15,000 MPa. Preferably, a resin film which is thermally-resistant in the temperature range of about 300° C. or higher is used. In particular, resin materials such as epoxy, polyimide, polyamide-imide types are used.

In this example, a square polyimide film having a length of about 10 mm, a thickness of about 7.5 $\mu$m, and a Young's modulus of elasticity of about 3400 MPa is preferably used.

As described below, to achieve a sufficient sound pressure characteristic, the area of the piezoelectric vibration plate 1 is preferably about 40% to about 70% of that of the resin film 10.

Figure 8:
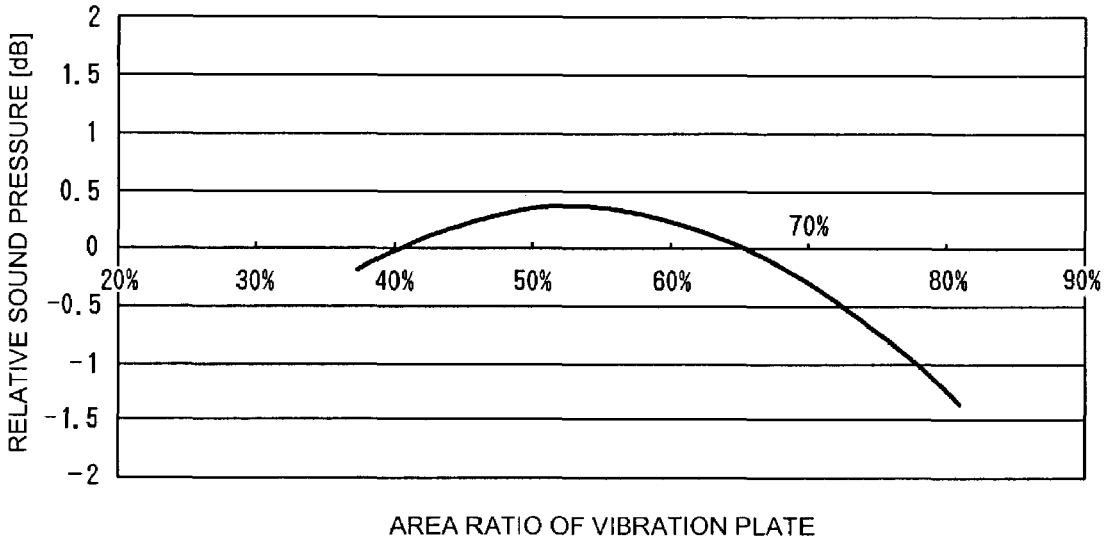
FIG. 8 is a graph showing the relationship between the area ratio of a vibration plate and the sound pressure.

FIG. 8 is a graph showing a relationship between the area ratio of the vibration plate 1 bonded to the square resin film 10 having a length of about 10 mm and the relative sound pressure (dB). The relative sound pressure is expressed by a sound-pressure conversion value, in which the sound pressure is defined as 0 dB for the displacement volume at a 100 Hz point of $1\times10^{-6}$ $m^3$.

As seen in FIG. 8, the relative sound pressure is substantially zero or greater in the area ratio range of the piezoelectric vibration plate 1 of about 40% to about 70%. That is, the obtained sound pressure is satisfactory. Also, it is seen that when the area ratio is less than about 40% or exceeds about 70%, the relative sound pressure reduces dramatically. The displacement quantity at the 100 Hz point is greatest when the area ratio of the piezoelectric vibration plate 1 is about 55%. In view of the sound pressure characteristic, it is most preferable to set the area of the vibration plate 1 at about 55%.

The case 20 preferably has a substantially quadrangular box shape, and has a bottom wall 20*a* and four side walls 20*b* to 20*e* each made of an insulating material such as a ceramic, a resin, a glass-epoxy resin, or other suitable insulating material. When the case 20 is made resin, the use of a thermally-resistant resin such as LCP(liquid crystal polymer), SPS(syndiotactic polystyrene), PPS(polyphenylenesulfide), epoxy, or other suitable thermally-resistant resin is preferable due to the adaptability for re-flow soldering. A ring-shaped supporting portion 20*f* that is larger than the piezoelectric vibration plate 1 is provided in the inner periphery of the four side walls 20*b* to 20*e*. The internal connecting portions 21*a* and 22*a* of a pair of terminals 21 and 22 are exposed near the supporting portion 20*f* on the inner sides of the two opposed side walls 20*b* and 20*d*. The terminals 21 and 22 are insert-molded. The outer connecting portions 21*b* and 22*b* of the terminals 21 and 22 extend along the outer surfaces of the side walls 20*b* and 20*d* and are bent onto the bottom surface of the case 20. In this preferred embodiment, the inner connecting portions 21*a* and 22*a* of the terminals 21 and 22 are bifurcated, respectively. These bifurcated inner connecting portions 21*a* and 22*a* are arranged near the corners of the case 20.

Guides 20*g* for guiding the outer periphery of the resin film 10 are provided on the outer sides of the supporting portions 20*f* and the inner sides of the four side walls 20*b* to 20*e*. Inclined surfaces, which gradually incline toward the lower, inner side, are provided on the inner side surfaces of the guides 20*g*, respectively. The resin film 10 is guided by the inclined surfaces to be accurately arranged on the supporting portions 20*f*. The supporting portions 20*f* are arranged so as to be lower than the inner connecting portions 21*a* and 22*a* of the terminals 21 and 22. Thus, when the resin film 10 is placed on the supporting portions 20*f*, the top surface of the vibration plate 1 and the upper surfaces of the inner connecting portions 21*a* and 22*a* of the terminals 21 and 22 have substantially the same height.

A first sound-emitting hole 20*h* is provided on the side wall 20*c* side of the bottom wall 20*a*.

The vibration plate 1 is mounted on the resin film 10, and the peripheral portion of the resin film 10 is placed on the supporting portions 20*f*. An electroconductive adhesive 13 is coated in a belt-pattern between the main surface electrode 2 exposed at the notch 8*a* and the inner connecting portion 21*a* of the terminal 21 and between the assisting electrode 7 exposed at the notch 8*b* and the internal connecting portion 22*a* of the terminal 22. As the conductive adhesive 13, a conductive adhesive having a high Young's modulus in the hardened state may be used. However, to avoid constraining the displacement of the resin film 10, a conductive paste having a low Young's modulus after the hardening is preferably used. In this example, a urethane-type conductive paste having a Young's modulus of elasticity of about $0.3\times10^9$ Pa after the curing is used. The conductive adhesive 13 is coated, and heated to be cured. Thus, the main surface electrode 2 and the internal connecting portion 21*a* of the terminal 21 are electrically connected to each other. Also, the assisting electrode 7 and the internal connecting portion 22*a* of the terminal 22 are connected to each other.

A coating agent having a Young's modulus of elasticity that is less than the conductive adhesive 13 is preferably coated and hardened on the resin film 10 between the main surface electrode 2 and the internal connecting portion 21*a* and between the assisting electrodes 7 and the internal connecting portion 221, respectively. The conductive adhesive 13 is preferably coated over the coating agent. Thereby, the constraining force of the conductive adhesive 13 applied to the resin film 10 is greatly reduced.

After the vibration plate 1 is connected to the inner connecting portions 21*a* and 22*a* of the terminals 21 and 22, respectively, the overall periphery of the resin film 10 is bonded to the supporting portions 20*f* via a sealing adhesive 14, such that the resin film 10 and the case 20 are sealed to each other. As the sealing adhesive 14, an adhesive having a high Young's modulus of elasticity in the cured state such as an epoxy type may be used. However, preferably, an elastic adhesive 14 having a low Young's modulus of elasticity is used to allow for displacement of the resin film 10. In this example, a silicone type adhesive having a Young's modulus of elasticity of about $3.0\times10^5$ Pa after the curing is preferably used.

After the vibration plate 1 and the resin film 10 are supported in the case 20 as described above, the cover 30 is bonded to cover the upper-side opening of the case 20. The cover is preferably made of the same material as that for the case 20. The bonding of the cover 30 provides an acoustic space between the cover 30 and the vibration plate 1. A second sound-emitting hole 32 is provided in the cover 30.

Thus, a surface-mounting type piezoelectric electro-acoustic transducer is provided.

In the electro-acoustic transducer of this preferred embodiment, the vibration plate 1 is vibrated in an area bending mode by application of a desired AC voltage across the terminals 21 and 22. A piezoelectric ceramic layer of which the polarization direction is the same as the electric field direction is contracted in the plane direction. A piezoelectric ceramic layer of which the polarization direction and the electric field direction are opposite to each other is expanded in the plane direction. As a whole, the vibration plate 1 is bent in the thickness direction.

The piezoelectric vibration plate 1 is bonded to the resin film 10 which is larger than the plate 1. The outer peripheral portion of the vibration plate 1 where no resin film 10 is provided is supported by the supporting portions 20*f* of the case 20. Accordingly, displacement of the vibration plate 1 is not constrained. Therefore, even if the vibration plate having the same size as that of a conventional vibration plate is used, the resonance frequency is greatly reduced. In addition, since the supporting constraining force is reduced, the displacement is greatly increased, and thus, a greatly increased sound pressure is achieved.

Figure 9:
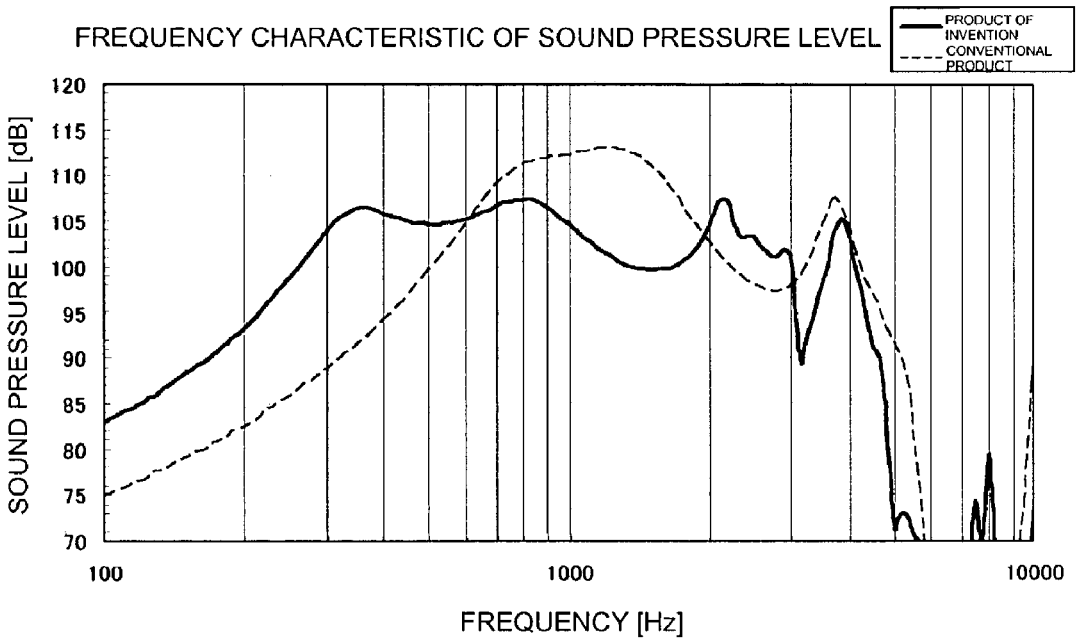
FIG. 9 is a graph showing the sound pressure characteristics of the products of the related art and preferred embodiment of the present invention for comparison.

FIG. 9 shows the sound pressure characteristics of a conventional product and the product accordingly the present invention. In the conventional product, two opposite sides of a piezoelectric vibration plate are bonded to the case, and the remaining two sides thereof are sealed with an elastic sealant. In the product according to preferred embodiments of the present invention, the vibration plate 1 is attached to the case via the resin film. The piezoelectric vibration plates used are preferably the same.

As shown in FIG. 9, for the conventional product, the sound pressure level is relatively high in the frequency range of about 700 Hz to about 1300 Hz, and is significantly reduced in the vicinity of frequencies of 300 Hz and 3 kHz. Thus, the sound pressure level changes considerably in the frequency range of 300 Hz to 3.4 kHz which is equal to the frequency band of human speech. On the other hand, according to the product of preferred embodiments of the present invention, a substantially flat sound pressure characteristic is obtained in the frequency range of 300 Hz to 3.4 kHz. Thus, it is seen that the sound pressure characteristic correspond to the reproduction of a wide band speed.

Figure 10:
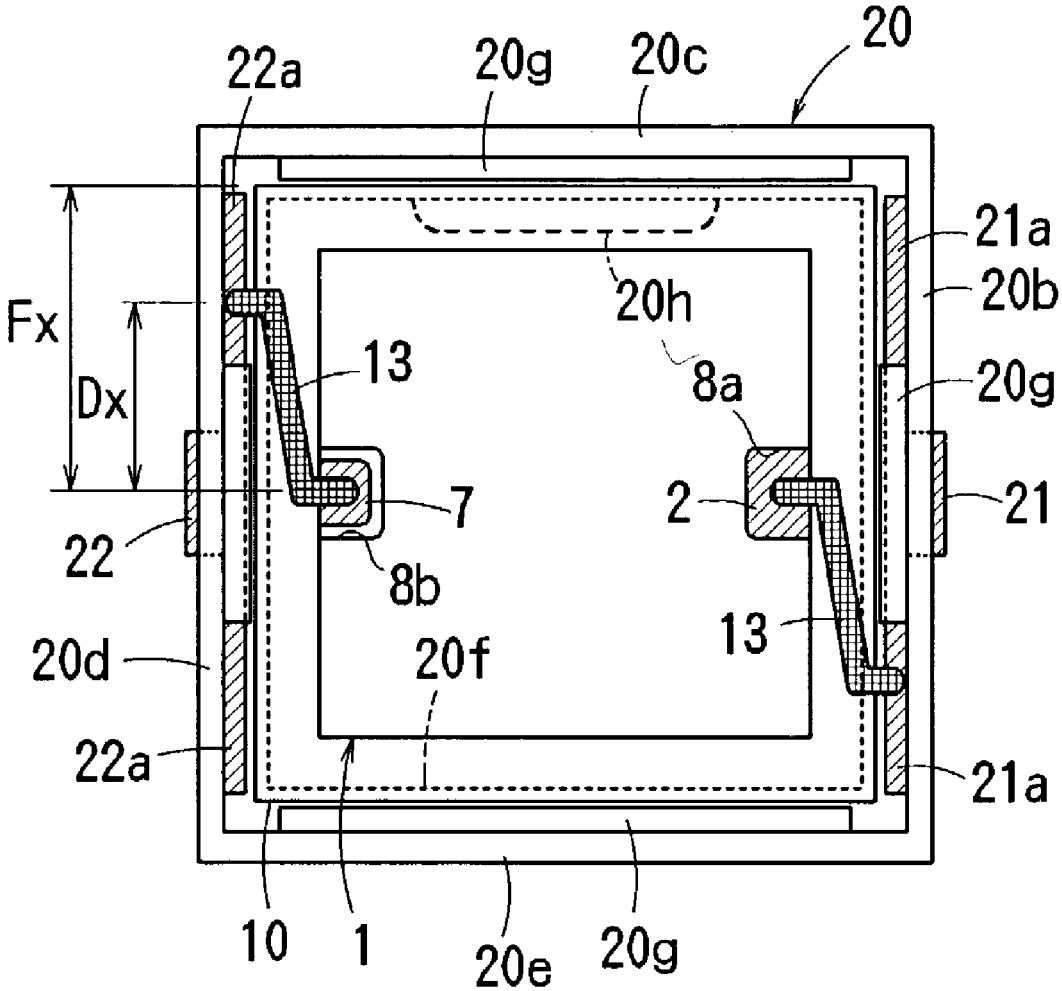
FIG. 10 is a plan view of a piezoelectric electro-acoustic transducer according to a second preferred embodiment of the present invention.

FIG. 10 shows a second preferred embodiment of the electro-acoustic transducer of the present invention.

To secure the electrical connection between the terminals 21 and 22 exposed in the case 20 and the electrode lead-out portions of the piezoelectric vibration plate 1, the conductive adhesive 13 as described in the first preferred embodiment can be used. However, in some cases, displacement of the resin film 10 is disrupted by the conductive adhesive 13, the resonance frequency is increased, and the sound pressure is divided. It is required that the thickness of the conductive adhesive 13 is as small as possible to reduce the constraining force on the film 10. However, it is difficult to obtain a uniform reduced coat thickness due to the dispersion of distortion of the vibration plate 1, the viscosity change of the conductive adhesive 13, and other factors.

This preferred embodiment reduces the resonance frequency and achieves the sound pressure characteristic without the sound pressure being divided by specifically selecting the locations of the electrode lead-out portions (the main surface electrode 2 and the assisting electrode 7) of the vibration plate 1 and the coating pattern of the conductive adhesive 13.

Figure 11:
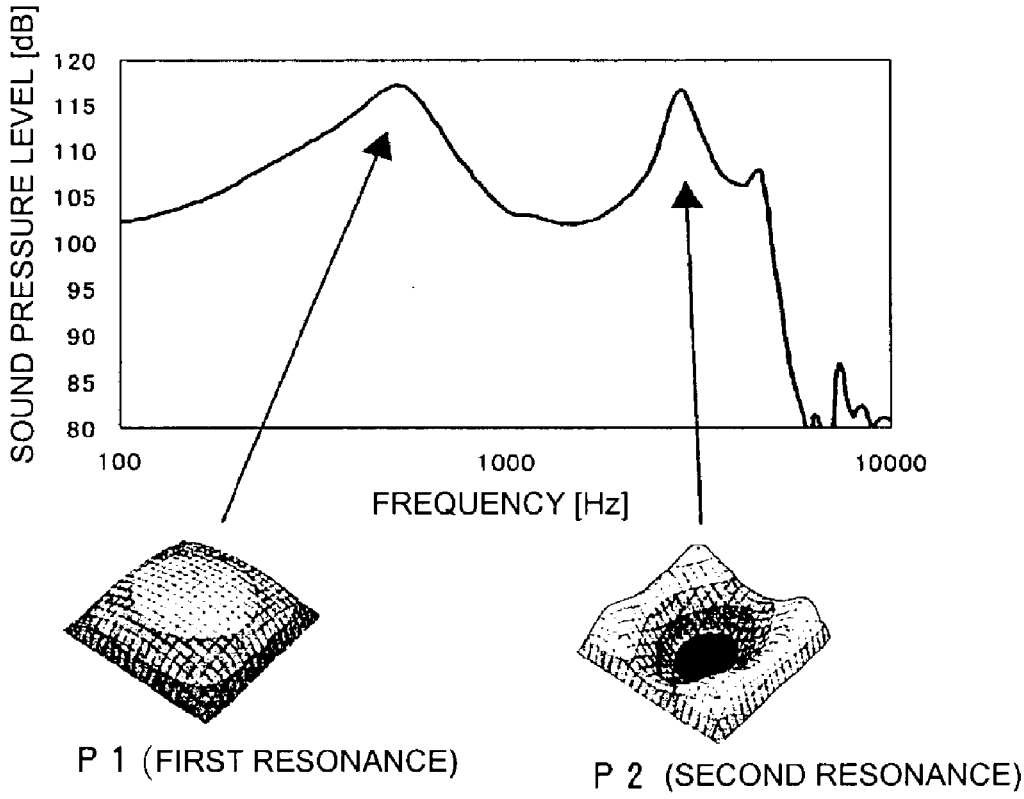
FIG. 11 is a waveform chart of the sound pressure of a vibration plate having no air-leakage.

FIG. 11 shows the sound-pressure characteristic of the vibration plate eliminating the air-leakage.

Referring to FIG. 11, a first peak P1 represents a first resonance, and a second peak P2 represents a second resonance. The first resonance has a vibration morphology in which the whole vibration plate is displaced in one direction. The second vibration has a vibration morphology in which the side ends and the central portion of the vibration plate are displaced in reversed phases.

Figure 12:
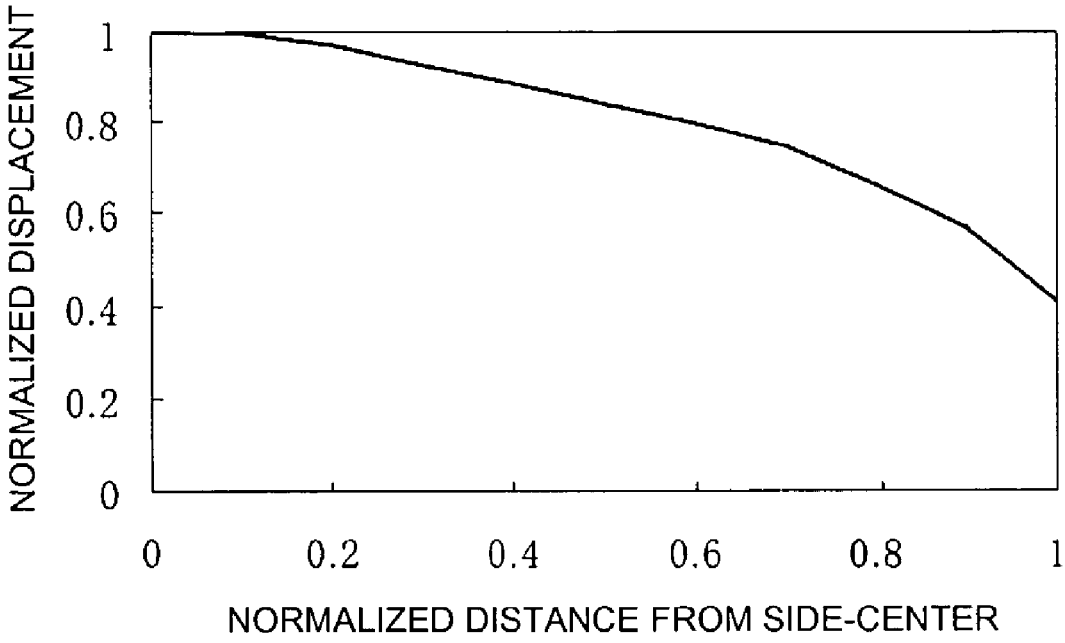
FIG. 12 is a graph showing the distribution of displacement of the peripheral portion of a resin film caused by the first resonance.

FIG. 12 shows a displacement distribution of the side portions of the resin film caused by the first resonance.

The normalized distance indicates the ratio of a distance from the center of a side based on the distance of the center of the side to one end thereof which is expressed by 1. The normalized displacement indicates the ratio of a displacement based on that at the center of a side that is expressed by 1. As seen in FIG. 12, the displacement of the resin film at the first resonance frequency is largest at the center of a side and is smallest at one end of the side.

Figure 13:
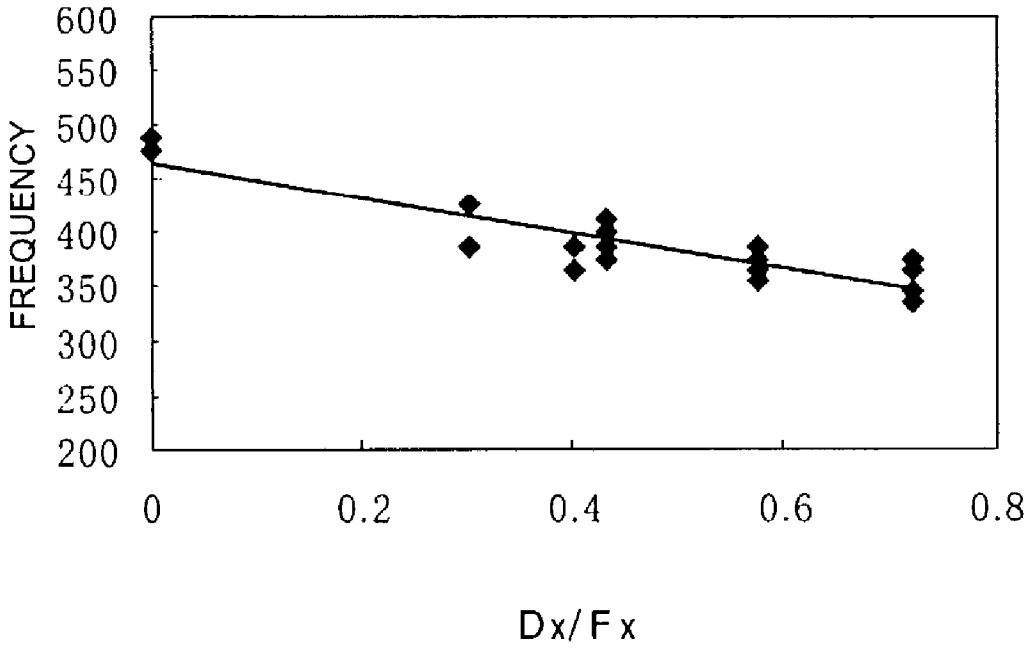
FIG. 13 is a graph showing a relationship between the coating position on the case side of a conductive adhesive and the first resonance frequency.

FIG. 13 shows a relationship between the coating position on the case side of the conductive adhesive and the first resonance frequency. In FIG. 13, Dx represents the distance of the coating location of the conductive adhesive from the center of the side of the case and Fx represents the distance of the end of the film from the center of the side of the case. The closer the coating location (terminal) on the case side of the conductive adhesive gets the center of the side of the case (the center of the side of the film), the more the first resonance frequency of the film is increased. Accordingly, to reduce the resonance frequency, the coating location on the case side of the conductive adhesive is preferably near the end of the film.

Figure 14:
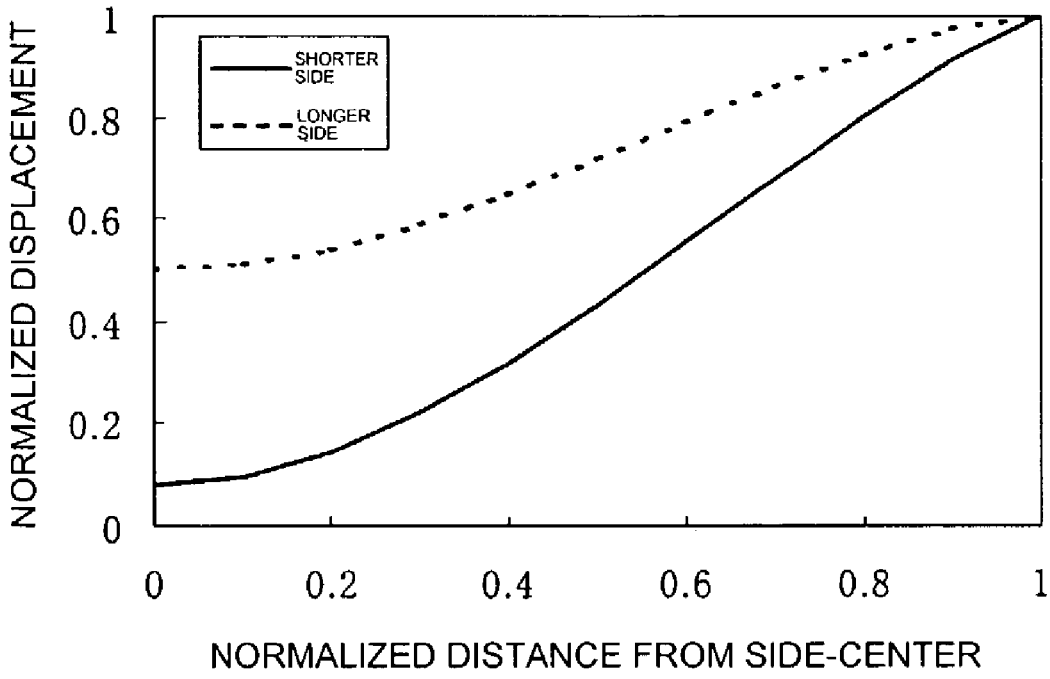
FIG. 14 shows graphs showing the distributions of a longer side and a shorter side of a substantially rectangular vibration plate.

FIG. 14 shows the displacement distributions of a longer side and a shorter side of a rectangular vibration plate 1.

As seen in FIG. 14, the displacement at the center of the shorter side is smallest. Thus, preferably, the electrode lead-out locations of the vibration plate 1, that is, the coating locations on the main surface electrode 2 and the assisting electrode 7 of the conductive adhesive are preferably at the centers of the shorter sides, respectively. Moreover, in the case in which a square vibration plate 1 is used, the displacement at the center of a side is smallest. Thus, it is preferable to set the electrode lead-out portions at the centers of the vibration plate.

Figure 15:
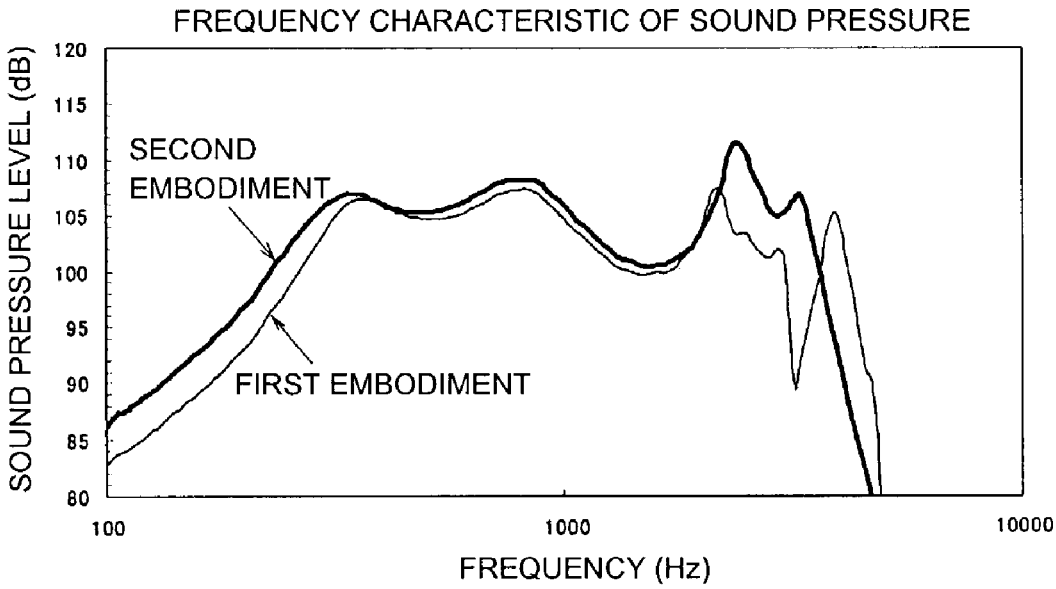
FIG. 15 shows waveform charts of the sound pressures of the first and second preferred embodiments of the present invention.

FIG. 15 shows the sound pressure waveforms of first preferred embodiment (see FIG. 1) and second preferred embodiment (see FIG. 10).

As seen in FIG. 15, the sound pressure waveforms at the first resonance are substantially the same. On the other hand, comparison of the sound pressure waveforms at the second resonance shows that the sound pressure waveform is divided in the first preferred embodiment, while no division of the sound pressure waveform occurs in the second preferred embodiment, that is, a good sound pressure characteristic is obtained. Accordingly, by setting the electrode lead-out portions of the vibration plate 1 at the centers of sides, and coating the conductive adhesive from the electrode lead-out portions to the terminals 21 and 22 through the corners of the resin film 10, respectively, the constraining force of the conductive adhesive applied to the resin film 10 is greatly reduced. Thus, the resonance frequency is decreased, and moreover, a sound pressure characteristic with no sound pressure splitting is obtained.

Figure 16:
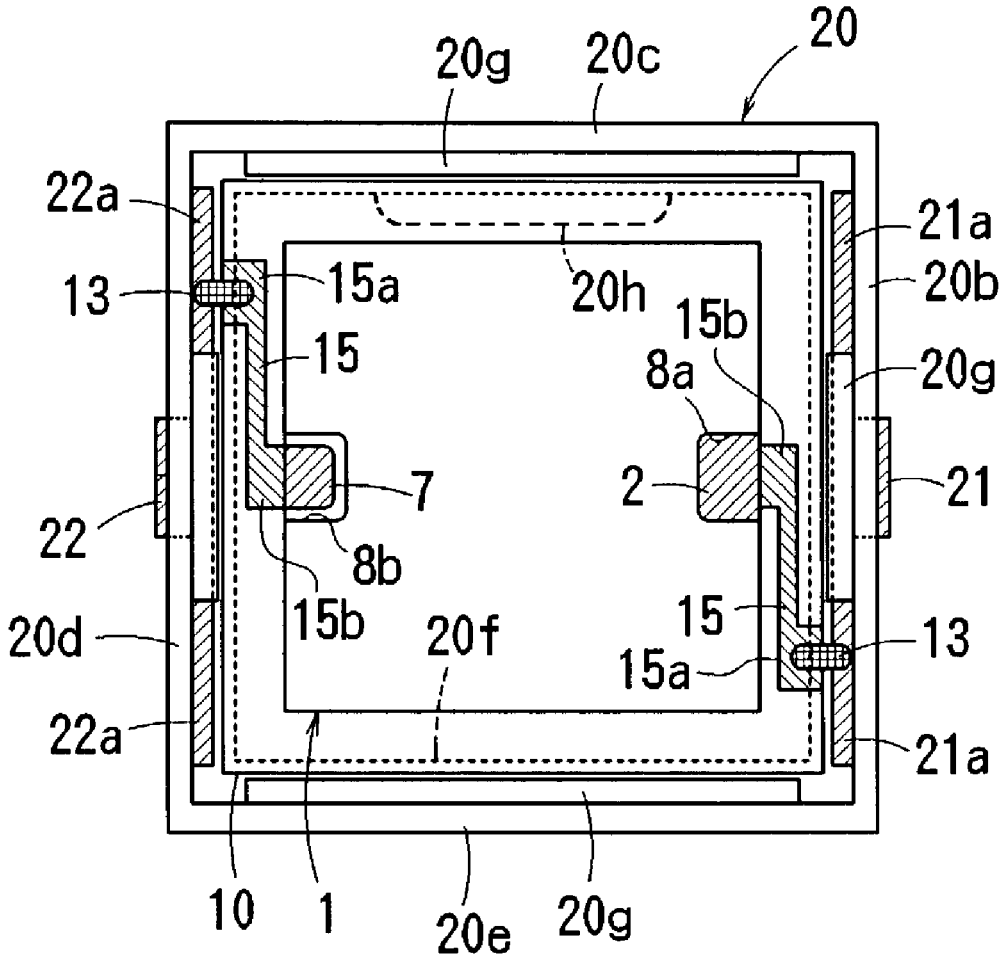
FIG. 16 is a plan view of an electro-acoustic transducer according to a third preferred embodiment of the present invention.

FIG. 16 shows a third preferred embodiment of the electro-acoustic transducer of the present invention.

In this preferred embodiment, thin-film electrodes 15*f* are arranged so as to extend from the electrode lead-out portions 2 and 7 to the peripheral-end portions of the resin film 10. The internal connecting portions 21*a* and 22*a* of the terminals 21 and 22 are connected to outer-connecting portions of the thin film electrodes 15 via a conductive material 13, respectively.

Connection of the inner connecting portions 15*b* of the thin film electrodes 15 to the electrode lead-out portions 2 and 7 is achieved, e.g., by overlapping a portion of the thin film electrodes 15 with the electrode lead-out portions 2 and 7, respectively, when the thin film electrodes 15 are formed. The thin film electrodes 15 can be formed by a known thin-film forming method, e.g., etching, sputtering, vapor deposition, or other suitable method.

In the electro-acoustic transducer of this preferred embodiment, only the thin-film electrodes 15 (thickness of up to about 3 $\mu$m, for example) are adhered to the resin film 10. Thus, the resin film 10 is freely displaced. Since the conductive adhesive 13 is adhered to the peripheral portion of the resin film 10 which is displaced to a small degree, the displacement of the resin film 10 is not disrupted. Therefore, the sound pressure characteristic is further improved as compared to the case in which the electrode lead-out portions 2 and 7 of the vibration plate 1 and the terminals 21 and 22 are connected to each other through the conductive adhesive 13, respectively.

In FIG. 16, the electrode lead-out portions 2 and 7 of the vibration plate 1 are arranged at the centers of the sides, respectively. Moreover, the thin film electrodes 15 are arranged so as to continuously extend from the electrode lead-out portions 2 and 7 to the side-ends of the resin film 10, respectively. However, the pattern of the thin film electrodes 15 is not limited to the above-described one.

For example, the thin film electrodes 15 may be arranged so as to extend from the side-ends of the piezoelectric vibration plate 1 to the side-ends of the resin film 10, respectively. Further, the thin film electrodes 15 may be arranged so as to extend from the centers of sides of the piezoelectric vibration plate 1 to the centers of the sides of the resin film 10, respectively.

Figure 17:
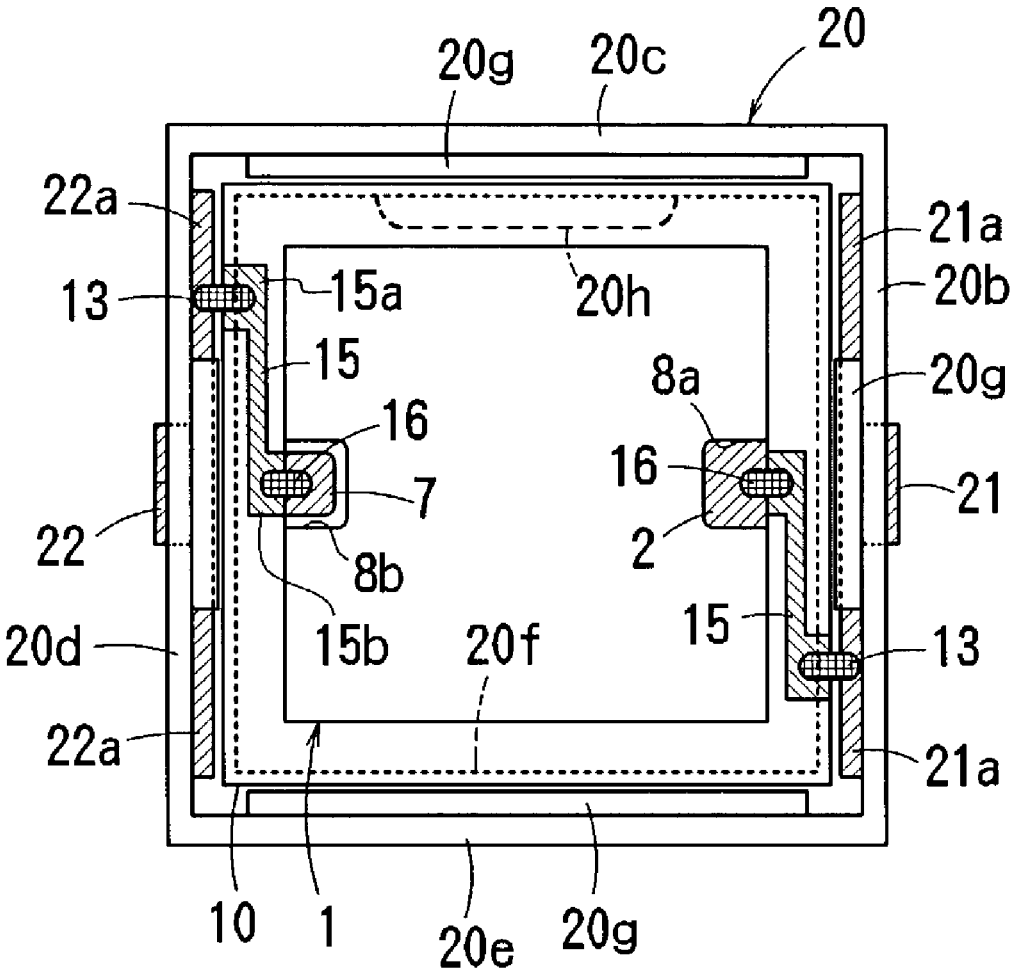
FIG. 17 is a plan view of an electro-acoustic transducer according to a fourth preferred embodiment of the present invention.

FIG. 17 shows a fourth preferred embodiment of the electro-acoustic transducer of the present invention.

The fourth preferred embodiment is a modification of the third preferred embodiment. The electrode lead-out portions 2 and 7 of the piezoelectric vibration plate 1 are connected to the inner connecting portions 15*b* of the thin film electrodes 15 via a conductive adhesive 16, respectively.

In this case, the conductive adhesive 16 adheres to the displacement portions of the resin film 10. However, the coating area of the conductive adhesive 16 is very small between the electrode lead-out portions 2 and 7 and the inner connecting portions 15*b*. Accordingly, the conductive adhesive 16 is less likely to disrupt the displacement of the resin film 10.

According to the fourth preferred embodiment, the thin film electrodes 15 are preferably formed on the surface of the resin film 10 in advance. The vibration plate 1 is bonded to the resin film 10. Thereafter, the conductive adhesive 16 is simply applied between the electrode lead-out portions 2 and 7 and the thin film electrodes 15, respectively. Thus, the resin film having the thin film electrodes is ideal for mass-production, and the production costs are greatly reduced.

In the first to fourth preferred embodiments, the substantially quadrangular piezoelectric vibration plate 1 is bonded to the quadrangular resin film 10 by way of an example. This is not restrictive.

Figure 18A:
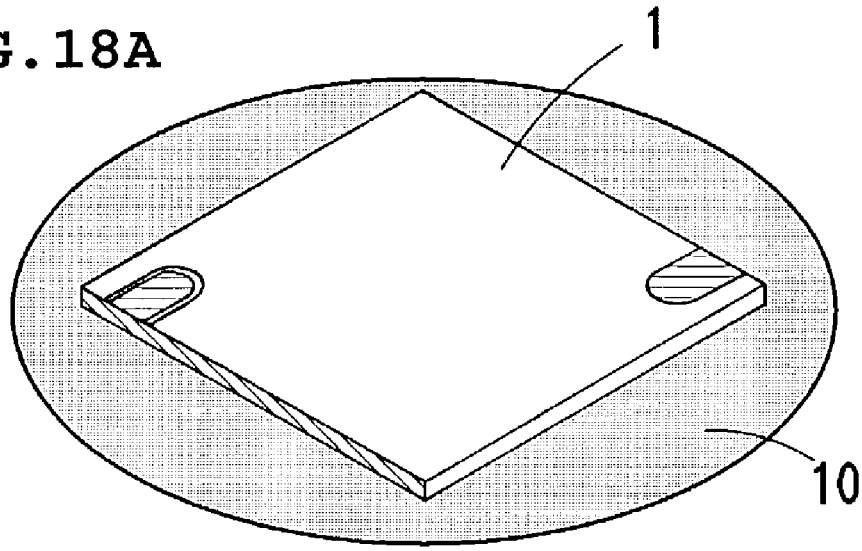
FIG. 18A is a perspective view of a second example of the vibration plate having a resin film according to preferred embodiments of the present invention.
Figure 18B:
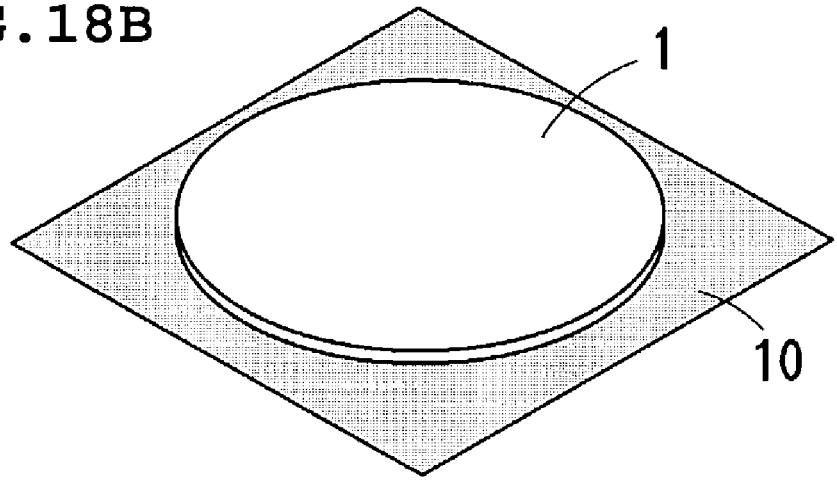
FIG. 18B is a perspective view of a third example of the vibration plate having a resin film according to preferred embodiments of the present invention.

FIG. 18A shows a second example of the vibration plate, in which the substantially quadrangular piezoelectric vibration plate 1 is bonded onto the substantially circular resin film 10. FIG. 18B shows a third example of the vibration plate, in which the substantially circular vibration plate 1 is bonded to the substantially quadrangular resin film 10.

In any of the above-described configurations, the same advantages and operation as those of the above-described preferred embodiments are obtained.

Figure 19:
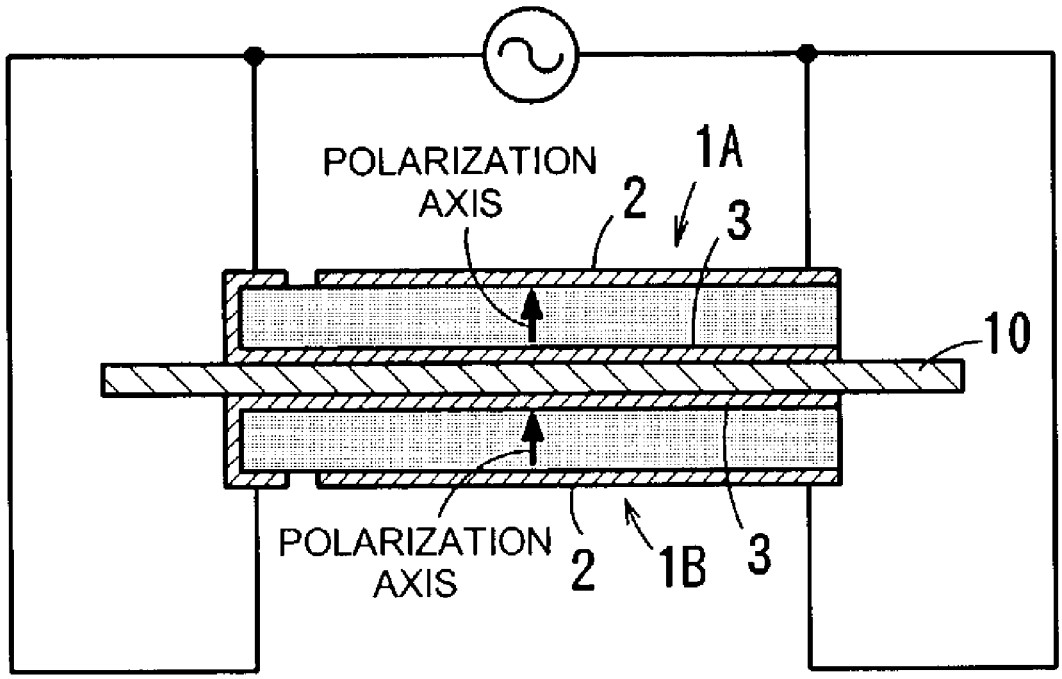
FIG. 19 is a cross-sectional view of a fourth example of the vibration plate having a resin film according to preferred embodiments of the present invention.

FIG. 19 shows a fourth example of the vibration plate according to preferred embodiments of the present invention.

In this example, piezoelectric vibration plates 1A and 1B are bonded to the front and back surfaces of one resin film 10, respectively. Thus, as a whole, a bimorph type vibration plate is provided.

Each of the piezoelectric vibration plates 1A and 1B includes one ceramic layer, and the main surface electrodes 2 and 3 are provided on the front and back surfaces of the ceramic layer. The polarization directions of the respective vibration plates 1A and 1B are the same. The main surface electrodes 3 opposed to the resin film 10 extend onto the front-side main surfaces passing through the end surfaces, respectively. The piezoelectric vibration plates 1A and 1B are vibrated radially in the opposite directions by applying an AC signal between the main surface electrodes 2 and 3 on the front and back surfaces.

When an AC signal is applied between the front surface electrode 2 and the back surface electrode 3 of each of the piezoelectric vibration plates 1A and 1B, the upper-side piezoelectric vibration plate 1A is expanded in the area direction, while the lower-side piezoelectric vibration plate 1B is contracted in the area direction, and then, the upper-side piezoelectric vibration plate 1A is contracted in the area direction, while the lower-side piezoelectric vibration plate 1B is expanded in the area direction. These operations are alternately repeated in the area direction. Accordingly, as a whole, area bending vibration is produced.

Also, in this case, an electro-acoustic transducer having a reduced size, an increased displacement, and a wide-band speech is provided by using the resin film 10 that is larger than each of the piezoelectric vibration plates 1A and 1B, and fixing the outer periphery of the resin film 10 to a case (not shown).

Figure 20:
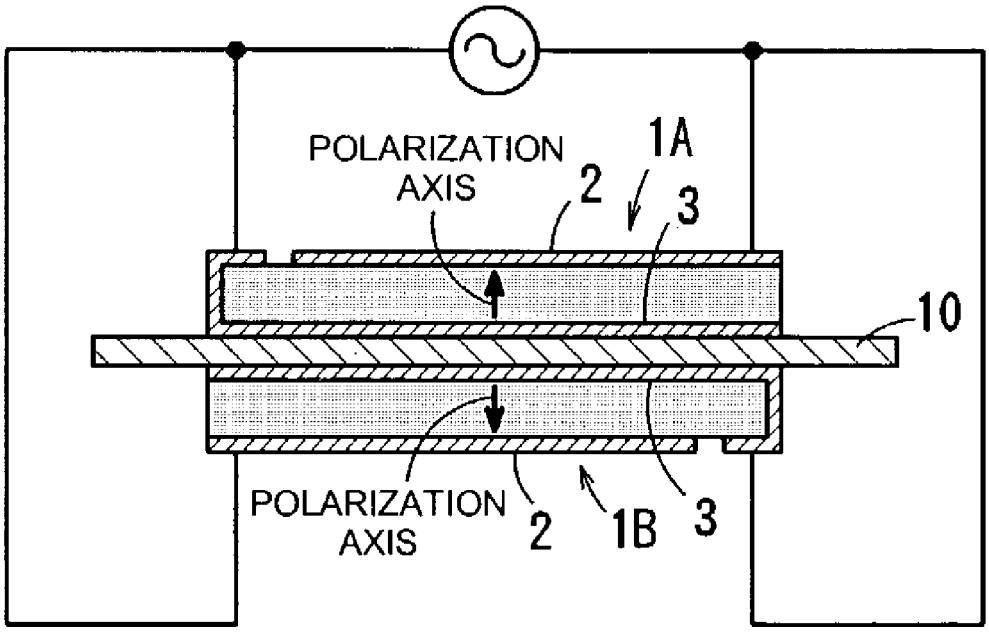
FIG. 20 is a cross-sectional view of a fifth example of the vibration plate having a resin film according to preferred embodiments of the present invention.

FIG. 20 shows a fifth example of the vibration plate according to preferred embodiments of the present invention.

In this example, the upper-side piezoelectric vibration plate 1A and the lower-side piezoelectric vibration plate 1B as shown in FIG. 19 have opposite polarization directions. The piezoelectric vibration plates 1A and 1B are bonded in such a manner that the right and left direction of one of the plates 1A and 1B is reversed to that of the other plate with respect to the resin film 10.

When an electric field is applied to one of the piezoelectric vibration plates in the same direction as that of the polarization thereof, an electric field is applied to the other piezoelectric vibration plate in the direction opposite to that of the polarization thereof. Therefore, when one piezoelectric vibration plate is expanded in the area direction, the other piezoelectric vibration plate is contracted in the area direction. Thus, as a whole, area bending vibration is produced similar to the fourth example.

Figure 21:
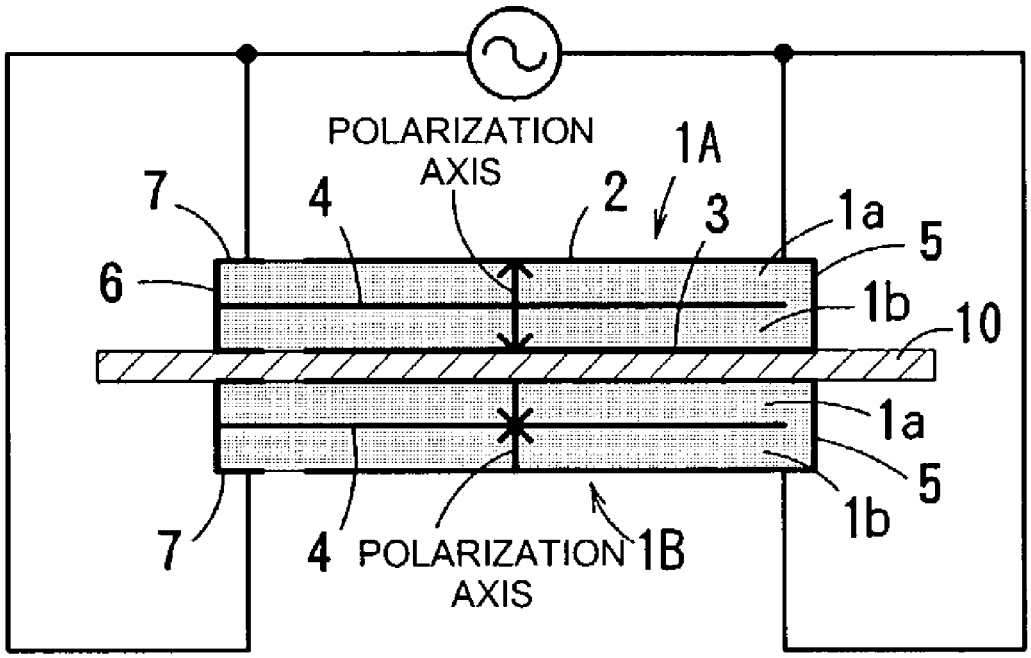
FIG. 21 is a cross-sectional view of a sixth example of the vibration plate having a resin film according to preferred embodiments of the present invention.

FIG. 21 shows a sixth example of the vibration plate according to preferred embodiments of the present invention.

In this example, two piezoelectric vibration plates 1A and 1B are bonded to the front and back surfaces of one resin film 10, respectively. Thus, as a whole, a bimorph type vibration plate is provided.

In FIG. 21, the piezoelectric vibration plates 1A and 1B preferably have the same structure as those shown in FIGS. 6 and 7 except that the polarization directions of the vibration plates 1A and 1B are opposite to each other. One piezoelectric vibration plate 1A includes two ceramic layers 1*a* and 1*b* having polarization axes which are directed toward the outside. The other piezoelectric vibration plate 1B includes two ceramic layers 1*a* and 1*b* having polarization axes which are directed toward the inside. When an AC signal is applied to both the piezoelectric vibration plates 1A and 1B, area expansion vibration is produced.

When an AC signal is simultaneously applied between the assisting electrode 7 connected to the inner connecting electrode 4 and the end surface electrode 5 connected to the main surface electrodes 2 and 3 of the piezoelectric vibration plate 1A and between those of the vibration plate 1B, the upper-side piezoelectric vibration plate 1A is expanded in the area direction, while the lower-side piezoelectric vibration plate 1B is contracted in the area direction. Thus, as a whole, area bending vibration is produced.

Also, in this case, an electro-acoustic transducer having a reduced size, an increased displacement, and wide-band speech reproduction is provided by using the resin film 10 that is larger than each of the piezoelectric vibration plates 1A and 1B, and fixing the outer periphery of the resin film 10 to a case (not shown).

Figure 22:
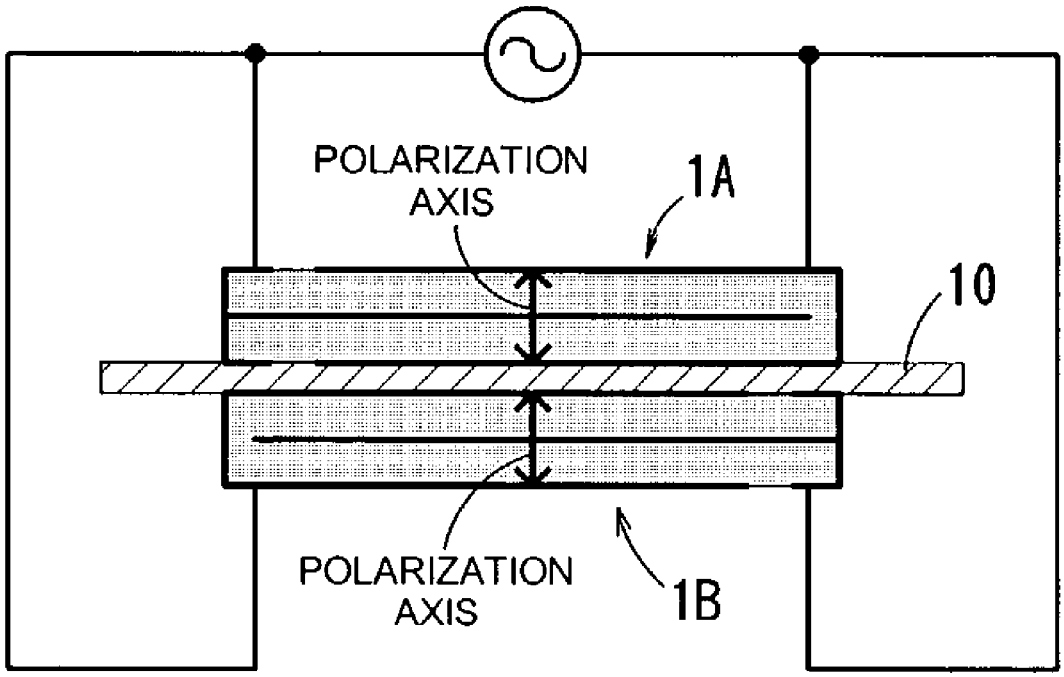
FIG. 22 is a cross-sectional view of a seventh example of the vibration plate having a resin film according to preferred embodiments of the present invention.

FIG. 22 shows a seventh example of the vibration plate according to preferred embodiments of the present invention.

In this vibration plate, the upper-side piezoelectric vibration plate 1A and the lower-side piezoelectric vibration plate 1B shown in FIG. 22 have polarization axial directions which are the same. The piezoelectric vibration plates 1A and 1B are bonded in such a manner that the right and left direction of one of the plates 1A and 1B is reversed to that of the other plate with respect to the resin film 10.

When an electric field is applied to the upper-side piezoelectric vibration plate 1A in the same direction as the polarization axial direction, an electric field is applied to the lower-side piezoelectric vibration plate 1B in the opposite direction to that of the polarization direction thereof. Therefore, when one piezoelectric vibration plate is expanded in the area direction, the other piezoelectric vibration plate is contracted in the area direction. Thus, as a whole, area bending vibration is produced.

The piezoelectric vibration plate 1 preferably includes two laminated piezoelectric ceramic layers. The piezoelectric vibration plate 1 may be formed by laminating at least three piezoelectric ceramic layers. In this case, the intermediate layer is a dummy layer which generates no area expansion vibration.

In the above-described preferred embodiments, to connect the electrode lead-out portions of the piezoelectric vibration plate to the terminals, the thin-film electrodes to the electrode lead-out portions, and also, the thin-film electrodes to the terminals, the conductive adhesive 13 is used. However, lead wires, Au wires or other suitable connection elements may be used. In this case, the well-known wire-bonding method may be used.

The terminals used in the present invention are not limited to the insert terminals as used in the above-descried preferred embodiments. For example, thin film electrodes or thick film electrodes extending from the upper sides of the supporting portion of the case toward the outside may be used.

Referring to the vibration plates described in the fourth to seventh examples and shown in FIGS. 19 to 22, conductive paste may be used to connect the respective vibration plates to the terminals provided on the case. Thin-film electrodes may be provided on the resin films for connection of the vibration plates to the terminals as shown in FIGS. 16 and 17. In these examples, the vibration plates can be bonded to the front and back surfaces of the respective resin films. Thus, the thin film electrodes may be formed on the front and back surfaces of the resin film.

It should be understood that the foregoing description is only illustrative of the present invention. Various alternatives and modifications can be devised by those skilled in the art without departing from the present invention. Accordingly, the present invention is intended to embrace all such alternatives, modifications and variances which fall within the scope of the appended claims.

What is claimed is:

1. A piezoelectric electro-acoustic transducer comprising:

a piezoelectric vibration plate having a plurality of piezoelectric ceramic layers laminated to each other with an internal electrode interposed between the piezoelectric ceramic layers, and main surface electrodes provided on the front and back surfaces thereof whereby area bending vibration is produced by applying an AC signal between the main surface electrodes and the internal electrode;

a resin film having a size that is greater than the size of the piezoelectric vibration plate, the piezoelectric vibration plate being bonded to a central portion of a surface of the resin film; and a case accommodating the piezoelectric vibration plate and the resin film; wherein the piezoelectric vibration plate has an area that is about 40% to about 70% of that of the resin film;

an inner peripheral surface of the case is provided with a supporting portion having a frame shape that is larger than that of the piezoelectric vibration plate; and an outer peripheral portion of the resin film having no piezoelectric vibration plate bonded thereto is supported by the supporting portion of the case.

2. A piezoelectric transducer according to claim 1, wherein the piezoelectric vibration plate includes electrode lead-out portions for externally leading out the main surface electrodes and the internal electrode of the piezoelectric vibration plate provided at substantially the center of opposed sides of the piezoelectric vibration plate;

the case includes first and second terminals fixed thereto, the terminals having one end exposed near corners on an inner side of the case; and the electrode lead-out portions of the piezoelectric vibration plate are electrically connected to the one end of the first and second terminals by a conductive adhesive extending from the electrode lead-out portions to the one end of the first and second terminals in the vicinities of the corners of the resin film, the resin film having the piezoelectric vibration plate bonded thereto is supported by the supporting portion of the case.

3. A piezoelectric electro-acoustic transducer according to claim 2, further comprising thin film electrodes are arranged so as to continuously extend from the electrode lead-out portions for externally leading the main surface electrodes and the internal electrode of the piezoelectric vibration plate to the periphery of the resin film; and the one end of the first and second terminals are connected to the thin film electrodes provided in the periphery of the resin film via a conductive material.

4. A piezoelectric electro-acoustic transducer according to claim 2, wherein said conductive adhesive has a Young's modulus of elasticity of about $0.3\times10^{9}$ Pa after curing.

5. A piezoelectric electro-acoustic transducer according to claim 1, wherein the resin film has a thickness that is less than a thickness of the piezoelectric vibration plate, and is made of a resin material having a Young's modulus of elasticity of about 500 MPa to about 15,000 MPa.

6. A piezoelectric electro-acoustic transducer according to claim 5, wherein the resin film is thermally resistant at a temperature of about 300° C. or higher.

7. A piezoelectric electro-acoustic transducer according to claim 1, wherein said piezoelectric vibrating plate includes resin layers provided on said main surface electrodes.

8. A piezoelectric electro-acoustic transducer according to claim 7, wherein said resin layers include notches provided therein such that portions of said main surface electrodes are exposed in said notches.

9. A piezoelectric electro-acoustic transducer according to claim 1, wherein said case further includes guides for guiding an outer periphery of said resin film onto said supporting portion.

10. A piezoelectric electro-acoustic transducer according to claim 1, wherein said case includes a hole provided in at least one of a top and bottom wall thereof.

11. A piezoelectric electro-acoustic transducer comprising:

a first piezoelectric vibration plate having a piezoelectric ceramic layer and main surface electrodes provided on front and back main surfaces of the piezoelectric ceramic layer, whereby area expansion vibration is generated by applying an AC signal between the main surface electrodes;

a second piezoelectric vibration plate having main surface electrodes provided on front and back main surfaces thereof, whereby area expansion vibration is generated in the direction opposite to that of the first piezoelectric vibration plate by applying of the AC signal between tile main surface electrodes of the second piezoelectric vibration plate;

a resin film having a size that is greater than each of the first and second piezoelectric vibration plates and having the first and second piezoelectric vibration plates bonded to the central portions of the surfaces on front and back surfaces of the resin film; and a case accommodating the first and second piezoelectric vibration plates and the resin film; wherein the first and second piezoelectric vibration plates each having an area of about 40% to about 70% of that of the resin film;

an inner peripheral surface of the case is provided with a supporting portion having a frame shape that is larger than each of the first and second piezoelectric vibration plates; and an outer peripheral portion of the resin film having no piezoelectric vibration plates bonded thereto is supported by the supporting portion of the case.

12. A piezoelectric transducer according to claim 11, wherein each of the first and second piezoelectric vibration plates includes electrode lead-out portions for externally leading out the main surface electrodes of the first and second piezoelectric vibration plates provided at substantially the center of opposed sides of the first and second piezoelectric vibration plates;

the case includes first and second terminals fixed thereto, the terminals having one end exposed near corners on an inner side of the case; and the electrode lead-out portions of the piezoelectric vibration plates are electrically connected to the one end of the first and second terminals by a conductive adhesive extending from the electrode lead-out portions to the one end of the first and second terminals in the vicinities of the corners of the resin film, the resin film having the piezoelectric vibration plate bonded thereto is supported by the supporting portion of the case.

13. A piezoelectric electro-acoustic transducer according to claim 12, further comprising thin film electrodes arranged so as to continuously extend from the electrode lead-out portions for externally leading the main surface electrodes of the piezoelectric vibration plates to the periphery of the resin film; and the one end of the first and second terminals are connected to the thin film electrodes provided in the periphery of the resin film via a conductive material.

14. A piezoelectric electro-acoustic transducer according to claim 12, wherein said conductive adhesive has a Young's modulus of elasticity of about $0.3\times10^9$ Pa after curing.

15. A piezoelectric electro-acoustic transducer according to claim 11, wherein the resin film has a thickness that is less than each of the first and second piezoelectric vibration plates, and is made of a resin material having a Young's modulus of elasticity of 500 MPa to 15000 MPa.

16. A piezoelectric electro-acoustic transducer according to claim 15, wherein the resin film is thermally resistant at a temperature of about 300° C. or higher.

17. A piezoelectric electro-acoustic transducer according to claim 11, wherein said case further includes guides for guiding an outer periphery of said resin film onto said supporting portion.

18. A piezoelectric electro-acoustic transducer according to claim 11, wherein said case includes a hole provided in at least one of a top and bottom wall thereof.

* * * * *